US012766401B2

(12) United States Patent
Che et al.

(10) Patent No.: US 12,766,401 B2
(45) Date of Patent: Oct. 20, 2026

(54) BOARD-CARRYING SUPPORT DEVICE

(71) Applicants: Xiaoling Che, Dangyang (CN); Xiaoyi Che, Dangyang (CN)

(72) Inventors: Xiaoling Che, Dangyang (CN); Xiaoyi Che, Dangyang (CN)

( * ) Notice: Subject to any disclaimer, the term of this patent is extended or adjusted under 35 U.S.C. 154(b) by 183 days.

(21) Appl. No.: 18/223,001

(22) Filed: Jul. 17, 2023

(65) Prior Publication Data

US 2023/0356070 A1 Nov. 9, 2023

Related U.S. Application Data

(63) Continuation-in-part of application No. 29/859,220, filed on Nov. 8, 2022, now Pat. No. Des. 1,004,709, and a continuation-in-part of application No. 17/720,682, filed on Apr. 14, 2022, now abandoned, and a continuation-in-part of application No. 29/824,951, filed on Jan. 28, 2022, now Pat. No. Des. 1,009,177, and a continuation-in-part of application No. 29/818,457, filed on Dec. 9, 2021, now Pat. No. Des. 1,029,113.

(30) Foreign Application Priority Data

Jan. 28, 2022 (CN) ..... 202210103787.9
Oct. 28, 2022 (CN) ..... 202230717091.6

(51) Int. Cl.
*A63F 9/10* (2006.01)

(52) U.S. Cl.
CPC ..... *A63F 9/1044* (2013.01); *A63F 2009/105* (2013.01)

(58) Field of Classification Search
CPC ... A63F 2009/105; A63F 9/1044; A47B 25/00
USPC ..... 108/59, 9, 20
See application file for complete search history.

(56) References Cited

U.S. PATENT DOCUMENTS 435,337 A * 8/1890 Wassenius ..... A47B 13/086 52/782.2
1,203,659 A 11/1916 Smith
1,987,768 A * 1/1935 Beiger ..... A47B 13/086 52/800.11
2,540,849 A * 2/1951 Walker ..... A47B 3/0915 108/91
3,125,971 A * 3/1964 Wetherill ..... A47B 25/00 108/125

(Continued)

*Primary Examiner* — Daniel J Troy
*Assistant Examiner* — Timothy M Ayres

(57) ABSTRACT

A board-carrying support device is provided and includes a support frame, a bearing board assembly, and a rotating connection member. A plane in which the support frame is located is defined as a reference plane, the support frame and the bearing board assembly are rotatably connected to each other through the rotating connection member to enable the bearing board assembly to be rotated between a first position and a second position, the first position and the second position of the bearing board assembly are on a same side of the reference plane. The board-carrying support device further includes a second reinforcing member connected to the support frame to support the support frame. When the bearing board assembly is rotated to reach the second position, an inclination angle between the bearing board assembly and the reference plane is less than 90°.

14 Claims, 16 Drawing Sheets

(56) References Cited

U.S. PATENT DOCUMENTS

| | | | | |
|---|---|---|---|---|
| 3,410,232 | A * | 11/1968 | Bills | A47B 9/14 108/146 |
| 3,661,100 | A * | 5/1972 | Tennant | A47B 3/0917 108/132 |
| 3,773,154 | A | 11/1973 | Mitchell | |
| 4,323,214 | A | 4/1982 | DeLuca | |
| 4,372,631 | A * | 2/1983 | Leon | A47B 27/02 312/231 |
| 4,664,039 | A | 5/1987 | Schneider | |
| 4,865,325 | A | 9/1989 | Stolz | |
| D400,600 | S | 11/1998 | Ackerman et al. | |
| 7,073,449 | B2 | 7/2006 | Pipkin | |
| 8,910,838 | B2 | 12/2014 | Palmer et al. | |
| 9,044,688 | B1 * | 6/2015 | Janay | B65D 25/22 |
| D977,025 | S | 1/2023 | Fan | |
| D986,339 | S | 5/2023 | Huang | |
| 11,723,454 | B2 * | 8/2023 | Nye | A47B 3/087 108/132 |
| 12,048,885 | B2 * | 7/2024 | Che | A63F 9/1044 |
| 12,059,631 | B2 * | 8/2024 | Che | A63F 9/1044 |
| 12,097,443 | B2 * | 9/2024 | Che | A47B 13/088 |
| 12,220,648 | B2 * | 2/2025 | Che | A47B 41/00 |
| 12,226,708 | B2 * | 2/2025 | Che | A47B 13/081 |
| 12,239,914 | B2 * | 3/2025 | Che | A63F 11/00 |
| 2003/0029985 | A1 | 2/2003 | Zeller et al. | |
| 2006/0075669 | A1 | 4/2006 | Chuang | |
| 2008/0276841 | A1 * | 11/2008 | Brauning | A47B 13/02 108/154 |
| 2009/0120334 | A1 * | 5/2009 | Wang | A47B 37/04 264/259 |
| 2011/0056412 | A1 | 3/2011 | Grammer et al. | |
| 2021/0170268 | A1 * | 6/2021 | Malki | A63F 9/1044 |
| 2024/0416220 | A1 * | 12/2024 | Zhang | F16M 11/08 |
| 2024/0416221 | A1 * | 12/2024 | Zhang | F16M 11/32 |
| 2025/0032897 | A1 * | 1/2025 | Zhang | F16M 11/42 |
| 2025/0058210 | A1 * | 2/2025 | Zhang | F16M 11/08 |
| 2025/0073571 | A1 * | 3/2025 | Zhang | A63F 9/1044 |

* cited by examiner

BOARD-CARRYING SUPPORT DEVICE

CROSS REFERENCE TO RELATED APPLICATIONS

The present application is continuation-in-part application of the following U.S. patent applications: U.S. patent application Ser. No. 17/720,682, filed on Apr. 14, 2022; U.S. design patent application Ser. No. 29/824,951, filed on Jan. 28, 2022; U.S. design patent application Ser. No. 29/818,457, filed on Dec. 9, 2021; U.S. design patent application Ser. No. 29/859,220, filed on Nov. 8, 2022; and contents of which is incorporated herein by its entireties.

TECHNICAL FIELD

The present disclosure relates to the field of jigsaw puzzle accessories, and in particular to a board-carrying support device.

BACKGROUND

Jigsaw puzzle, as a game or teaching tool, has been quite popular since it was invented. It is not only due to the low cost of manufacturing jigsaw puzzle, but also because of the diverse puzzle patterns, various numbers of the puzzle pieces, and other adjustable variables of the jigsaw puzzle games, giving people more playability. In addition, as the living standard continuously increases and the society develops day by day, the jigsaw puzzle is utilized as a hobby, besides of a puzzle game or a preschool education tool. Because there are many jigsaw puzzle lovers, jigsaw puzzles with more patterns, various difficulties are present on the market, including double-sided puzzles, three-dimensional puzzles, and etc.

Currently, jigsaw puzzles are mostly made of cardboards, and the pattern of the jigsaw is the pattern drawn on the surface of the cardboard before cutting. The painted cardboard is stamped by special machine tool to complete the manufacturing. As a result, the puzzle pieces without external adhesive are difficult to be connected with each other tightly. Therefore, during the process of a jigsaw game, the player usually prepares a support panel or a special table for placing the puzzle pieces. However, in the process of a jigsaw puzzle game, it is very likely that the puzzle piece picked every time is not the puzzle piece adjacent to the previously picked puzzle piece in terms of the pattern of the puzzle. Therefore, the player has to drop several puzzle pieces on the desktop, usually rendering puzzle pieces placed on the corners of the desktop away from the player, and due to the flatness of the desktop, the view angle of the player is difficult to focus on the puzzle pieces located at the corner of the desktop in real time. Consequently, the player cannot comprehensively consider the pattern of the puzzle in an overall manner in the game process, which decreases the playability of the game. Meanwhile, when some puzzle pieces are placed on the corner of the desktop far away from the player, it is difficult for the player to reach and pick up the corresponding puzzle pieces, which will also significantly affect the game experience of the player.

SUMMARY OF THE DISCLOSURE

The present disclosure provides a board-carrying support device, including a support frame, a bearing board assembly, and a rotating connection member. A plane in which the support frame is located is defined as a reference plane. The support frame and the bearing board assembly are rotatably connected to each other through the rotating connection member, enabling the bearing board assembly to be rotated between a first position and a second position. The first position and the second position of the bearing board assembly are on a same side of the reference plane. The board-carrying support device further comprises a second reinforcing member connected to the support frame to support the support frame. When the bearing board assembly is rotated to reach the second position, an inclination angle between the bearing board assembly and the reference plane is less than 90°.

BRIEF DESCRIPTION OF THE DRAWINGS

In order to illustrate the technical solutions of embodiments of the present disclosure more clearly, the accompanying drawings used for describing the embodiments will be briefly described in the following. Obviously, the following drawings are only some of the embodiments of the present disclosure, and any ordinary skilled person in the art may obtain other drawings based on these drawings without any creative work.

DETAILED DESCRIPTION

Figure 1:
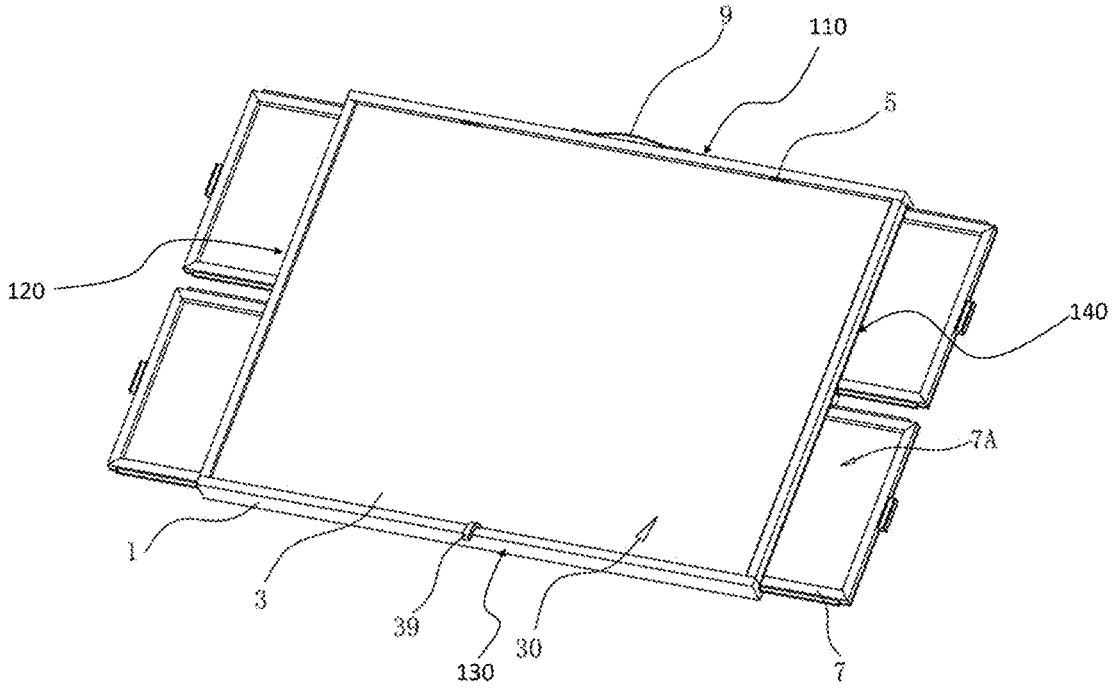
FIG. 1 is a perspective view of a bearing board assembly of the board-carrying support device being in the first position according to an Embodiment I of the present disclosure.

In order to illustrate the purpose, technical solutions and advantages of the present disclosure more clearly, each embodiment of the present disclosure will be described in detail below by referring to the accompanying drawings. However, any ordinary skilled person in the art shall understand that many technical details are presented in the embodiments of the present disclosure in order to enable the reader to better understand the present disclosure. However, even without these technical details and various variations and modifications based on the following embodiments, the technical solution claimed by the present disclosure may still be achieved.

Embodiment I

As shown in FIG. 1 to FIG. 15, the board-carrying support device includes a support frame 1, a bearing board assembly 3, and a rotating connection member 5. The support frame 1 and the bearing board assembly 3 are rotatably connected to each other through the rotating connection member 5, enabling the bearing board assembly 3 to be rotated between a first position and a second position, such that an inclination angle of the bearing board surface 30 of the bearing board assembly 3 may change. In this way, the inclination angle of the bearing board assembly 3 may be adapted to a viewing angle of the player of the jigsaw puzzle, and the player may fully focus on the puzzle pieces located on the various locations of the bearing board assembly 3 and may easily reach and pick up the puzzle pieces located on the various locations of the bearing board assembly 3 during playing the jigsaw puzzle. Therefore, the game experience of the player of the jigsaw puzzle may be enhanced, and attraction of the jigsaw puzzle to the player may be improved.

A plane in which the support frame 1 is located is defined as a reference plane. The first position and the second position of the bearing board assembly 3 are located on a same side of the reference plane. Further, when the bearing board assembly 3 is rotated to reach the second position, the inclination angle between the bearing board assembly 3 and the reference plane is less than 90°.

To be noted that, the first position of the bearing board assembly 3 refers to a position, which is reached by the bearing board assembly 3 being rotated, through a rotation shaft of the rotating connection member 5, and is parallel or almost parallel to the reference plane. It will be understood that, the first position is not limited to the position, which is reached by the bearing board assembly 3 being rotated and is parallel or almost parallel to the reference plane. For example, the first position may alternatively be a position, which is reached by the bearing board assembly 3 being rotated and has a slight angle (such as 1°, 2°, 3°, and so on) with respect to the reference plane.

The second position of the bearing board assembly 3 refers to a position, which is reached by the bearing board assembly 3 being rotated and has the inclination angle with respect to the reference plane. In some embodiments, the inclination angle is less than 90°. In some embodiments, the inclination angle is set to be greater than or equal to 10° and less than or equal to 60°. The inclination angle enables the bearing board assembly 3 to be adapted to carry the puzzle pieces and to be adapted to the viewing point of the player. In this way, the player may be provided with a better jigsaw puzzle playing experience, and playability of the jigsaw puzzle may be improved, such that the viewing point of the player may be adapted, and a carrying capacity and stability of the bearing board assembly 3 carrying the puzzle pieces may be improved.

The support frame 1 and the bearing board assembly 3 are hingedly connected to each other through the rotating connection member 5. The rotating connection member 5 may be a hinge. In other embodiments, the rotating connection member 5 may also be a rotation shaft.

The support frame 1 includes a first side wall 11, a second side wall 12, and a pair of third side walls 13. The first side wall 11 is connected to the bearing board assembly 3 through the rotating connection member 5. The second side wall 12 is opposite to the first side wall 11. One third side wall of the pair of third side walls 13 is connected to the first side wall 11, and the other one third side wall of the pair of third side walls 13 is connected to the second side wall 12. The one third side wall 13 is connected to an end of the first side wall 11 through a screw, and the other one third side wall 13 is connected to an end of the second side wall 12 through another screw.

The first side wall 11 may receive a heavy loading while the bearing board assembly 3 is being rotating through the rotating connection member 5, and the bearing board assembly 3 and the support frame 1 are usually made of wood. Therefore, when the first side wall 11 of the support frame 1 connected to the rotating connection 5 member is a layering structure (such as laminated sheets), the loading is quite close to a support force applied by the side wall of the layering structure to the rotating connection member 5 (that is, the support force applied by the side wall of the layering structure to the rotating connection member 5 may be insufficient). Therefore, in the present disclosure, the first side wall 11 of the support frame 1 is a one-piece and integral structure. That is, the first side wall 11 is a one-piece of wood, and is not a laminated multi-layer wooden structure, such that the support force applied by the first side wall 11 of the support frame 1 to the rotating connection member 5 is increased, and the service life of the device is increased.

In the present embodiment, the bearing board assembly 3 is hingedly connected to an inner side of the support frame 1. Further, when the bearing board assembly 3 is rotated to reach the first position, the bearing board assembly 3 is arranged inside the support frame 1. In this way, when the board-carrying support device is not in use, the bearing board assembly 3 may be folded to be completely received inside the support frame 1, such that the board-carrying support device is compact after being folded and can be stored easily.

In the present embodiment, the first side wall 11 defines a first recess 111 and a second recess 112 at a position opposite to the second side wall 12, and the second side wall 12 also defines a first recess 111 and a second recess 112 at a position opposite to the first side wall 11. The first recess 111 is spaced apart from the second recess 112.

A middle board 16 is fixedly arranged inside the support frame 1. A circumference of the middle board 16 is embedded in the first recess 111, and the middle board 16 is connected to the third side wall 13, such that the middle board 16 is fixedly arranged inside the support frame 1.

A plate surface of the middle board 16 is parallel to the reference plane in order to limit rotation of the bearing board assembly 3. In this way, on one hand, structural stability of the board-carrying support device may be improved. On the other hand, an accommodation space may be defined between the middle board 16 and the bearing board assembly 3 to increase the storage capacity of the board-carrying support device. In particular, for example, a finished jigsaw puzzle may be accommodated in the accommodation space, further increasing usefulness of the board-carrying support device.

It is worth mentioning that when the bearing board assembly 3 is rotated to reach the first position, the bearing board assembly 3 is received inside the support frame 1. That is, a stacked state of the bearing board assembly 3 and the middle board 16 is formed. In this way, a size of the board-carrying support device may be reduced, the board-carrying support device may be stored easily, and the board-carrying support device may be transported and carried easily.

It is worth mentioning that in the present embodiment, the support frame 1 is an enclosed frame to ensure the structural stability of the support frame 1. To be understood that, in some embodiments of the present disclosure, the support frame 1 is not limited to be the enclosed frame. That is, the support frame 1 may be implemented as an opening frame, such as a structure formed by two frame bars fixed on a same plane, as long as the support frame 1 defines a plane.

The bearing board assembly 3 includes a bearing board 31 and a bearing frame 33. The frame 33 is arranged around the bearing board 31 and is connected to the rotating connection member 5. The frame 33 is arranged with a mounting portion 331, and the bearing board 31 is mounted in the mounting portion 331.

The bearing board 31 and the frame 33 may be made of a same material or different materials. In some embodiments, the bearing board 31 and the frame 33 have different expansion coefficients. An expansion coefficient of the frame 33 is lower than that of the bearing board 31, such that a greater support force is provided to ensure flatness of the bearing board 31.

The mounting portion 331 includes a first mounting surface 333 and a retaining surface 335. The first mounting surface 333 is configured to mount the bearing board 31. The retaining surface 335 is opposite to a side edge of the bearing board 31. The retaining surface 335 is connected with the first mounting surface 333.

It will be understood that in other embodiments, the mounting portion 331 may include a second mounting surface 337 and the retaining surface 335. The second mounting surface 337 is opposite to the first mounting surface 333, and the retaining surface 335 is connected to the second mounting surface 337. The first mounting surface 333, the second mounting surface 337, and the retaining surface 335 cooperatively define a mounting slot to receive the side edge of the bearing board 31.

In the present embodiment, a gap 3A having a predetermined spacing is defined between the retaining surface 335 and the bearing board 31. The gap 3A provides a space for deformation of the bearing board 31 or/and the frame 33. In this way, the bearing board assembly 3 may be prevented from being deformed caused by expansion of the bearing board 31 and the frame 33 and/or compression between the bearing board 31 and the frame 33 due to an external force applied on the frame 33.

In the present embodiment, a friction pad 35 is arranged on a side of the bearing board assembly 3 away from the reference plane. The friction pad 35 is configured to increase friction between the bearing board assembly 3 and an object carried on the bearing board assembly 3. In this way, static friction between the bearing board assembly 3 of the bearing board assembly 3 and any puzzle piece carried on the bearing board assembly 3 may be increased, such that the puzzle pieces placed on the bearing board assembly 3 may be stabilized and may be prevented from falling apart due to external forces such as wind blowing. In particular, assembled puzzle pieces, while the jigsaw puzzle game is being performed, may be prevented from being scattered around due to the wind blowing, such that the progress of the game and the mood of the user may not be affected, and the player may play the jigsaw puzzle game more comfortably and may have a better playing experience.

In particular, with the structure "the support frame 1 and the bearing board assembly 3 are connected to each other through the rotating connection member 5, enabling the bearing board assembly 3 to be rotated between the first position and the second position", the bearing board assembly 3 may be designed in various forms. For example, the bearing board assembly 3 may be circular, polygonal, or irregularly shaped. The shape of the bearing board assembly 3 may be determined based on demands of various users. Especially, the shape of the bearing board assembly 3 may be determined to be flexibly adapted to various shapes of puzzles. For example, the circular bearing board assembly 3 may be more adaptable to puzzles having an overall circular pattern.

In the present embodiment, the bearing board assembly 3 is rectangular, such that the entirety of the bearing board assembly 3 may carry the puzzle pieces and meet the gamer's habit of placing and laying out the puzzle pieces while the player is playing the jigsaw puzzle game. Specifically, the rectangular bearing board assembly 3 (rectangular or square) may be adapted to carry various shapes of puzzle, such as, but not limited to, a jigsaw puzzle having an overall rectangular shape, a jigsaw puzzle having an overall circular shape, a jigsaw puzzle having an overall polygonal shape, and so on. In this way, the bearing board assembly 3 may be adapted to a wide range of jigsaw puzzles, the production and design costs and the purchasing and usage costs of board-carrying support device may be reduced, facilitating promotion and application of board-carrying support devices. In addition, the rectangular bearing board assembly 3 may be easily rotated, the board-carrying support device may be operated easily, and a better user experience may be provided.

In the embodiments, the friction pad 35 covers the bearing board 31 and the frame 33. Specifically, in a direction perpendicular to the bearing board assembly 3, an edge of the friction pad 35 overlaps an outer edge of the frame 33. Specifically, the friction pad 35 may be a fleece. It will be understood that in other embodiments, the fleece may also be replaced with a friction pad made of a material having a greater frictional force, such as a rubber pad.

It will be understood that in other embodiments, the friction pad 35 may cover only the bearing board 31. Specifically, in the direction perpendicular to the bearing board assembly 3, the edge of the friction pad 35 overlaps an edge of the bearing board 31. Alternatively, the friction pad 35 may cover the bearing board 31 and a part of the frame 33. That is, in the direction perpendicular to the bearing board assembly 3, the edge of the friction pad 35 falls on the frame 33.

Further, a plurality of first reinforcement members 37 are connected with each other and are arranged inside the frame 33. The plurality of first reinforcement members 37 are disposed on a side of the bearing board 31 facing towards the support frame 1. The plurality of first reinforcement members 37 support the bearing board 31. In this way, overall strength of the bearing board assembly 3 may be improved. In some embodiments, at least four the first reinforcement members 37 may be arranged, including two reinforcement ribs extending transversely and two reinforcement ribs extending longitudinally. The transversely extending reinforcement ribs and the longitudinally extending reinforcement ribs cross over each other. It will be understood that in some embodiments, the first reinforcement members 37 may also omitted from the inside of the frame 33.

The bearing board assembly 3 further includes a connection rib 38, connected to the bearing board 31.

In the present embodiment, while the jigsaw puzzle game being performed, the player desires to have a stable inclined surface. Specifically, one of the middle board 16 and the bearing board assembly 3 is rotatably connected to a position limiting bracket 17, and the other one of the middle board 16 and the bearing board assembly 3 is fixedly arranged with at least one fixed angle platform 14. The position limiting bracket 17 is rotatable to abut against the fixed angle platform 14 to support the bearing board assembly 3, such that the angle between the bearing board assembly 3 and the reference plane is fixed. In this way, the bearing board assembly 3 having a stable angle may be simply and easily for the player, providing a better puzzle playing experience.

In the present embodiment, the position limiting bracket 17 is supported at a middle of the bearing board assembly 3.

The position limiting bracket 17 is rotatably connected to the bearing board 31 of the bearing board assembly 3. The fixed angle platform 14 is fixed to the middle board 16. A plurality of fixed angle platforms 14 are arranged in a direction perpendicular to the rotation shaft of the bearing board assembly 3 and are arranged spaced apart from each other. In this way, the position limiting bracket 17 may abut against different fixed angle platforms 14 to achieve various angles between the bearing board assembly 3 and the reference plane. Specifically, when the position limiting bracket 17 abuts against a fixed angle platform 14 disposed closer to the rotation shaft of the bearing board assembly 3, the angle between the bearing board assembly 3 and the reference plane may be greater.

In the present embodiment, the position limiting bracket 17 includes a fixing member 176 and a support portion 175. The fixing member 176 is fixed to the bearing board assembly 3. The support portion 175 is rotatably connected to the fixing member 176. The support portion 175 abuts against the fixed angle platform 14 to support the bearing board assembly 3. The support portion 175 is substantially U-shaped and includes a cross rod 1751, a pair of diagonal rods 1752, and a fixing rod. The cross rod 1751 abuts against the fixed angle platform 14. The pair of diagonal rods 1752 respectively extend from two ends of the cross rod 1751 towards the bearing board assembly 3. The fixing rod extends from an end of each diagonal rod 1752 towards the fixing member 176. The fixing rod is rotatably extends through the fixing member 176. In the present embodiment, the fixing member 176 is disposed between connection ribs 38. When the fixing rod is extending through the fixing member 176, the connection rib 38 blocks the fixing rod to prevent the fixing rod from sliding out of the fixing member 176.

Figure 15:
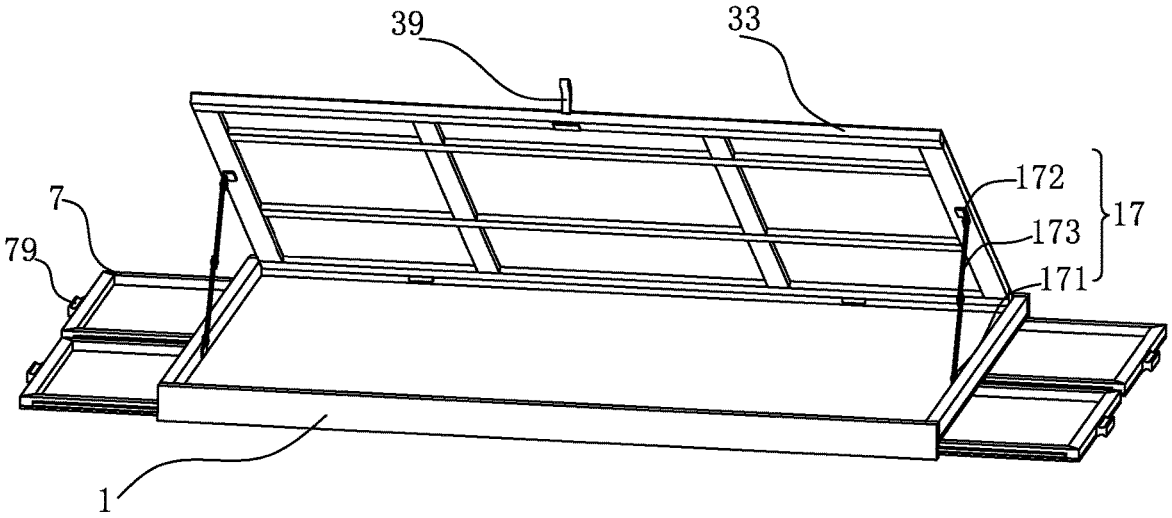
FIG. 15 is a perspective view of the board-carrying support device having another implementation of a position limiting bracket.

In other embodiments, as shown in FIG. 15, the position limiting bracket 17 is supported on each of two sides of the bearing board assembly 3. The position limiting bracket 17 includes a first fixing portion 171, a second fixing portion 172, and a fixing bracket 173. The first fixing portion 171 is fixed to the support frame 1. The second fixing portion 172 is fixed to the frame 33. The fixing bracket 173 is connected to the first fixing portion 171 and the second fixing portion 172. The fixing bracket 173 is detachably connected to the first fixing portion 171 or the second fixing portion 172.

It will be understood that in some embodiments, the position limiting bracket 17 may be rotatably connected to the middle board 16, and the fixed angle platform 14 is fixed to the bearing board 31 or to the first reinforcement member 37.

Based on maintaining a state between the bearing board assembly 3 and the support frame 1 while the bearing board assembly 3 being in the first position, the board-carrying support device further includes a connection structure 6. The connection structure 6 includes a first connection structure 61 fixed to the bearing board assembly 3 and a second connection structure 63 fixed to the middle board 16. When the bearing board assembly 3 is rotated to reach the first position, the first connection structure 61 and the second connection structure 63 are detachably connected with each other. The connection structure 6 is arranged to maintain the state between the bearing board assembly 3 and the support frame 1 while the bearing board assembly 3 being in the first position, preventing the bearing board assembly 3 from being rotated, such that the board-carrying support device may be transported and stored easily.

Specifically, the first connection structure 61 is fixed to the bearing frame 33, and the second connection structure 63 is fixed to the middle board 16. It will be understood that in some embodiments, the first connection structure 61 may be fixed to the bearing board 31.

In an embodiment of the present disclosure, the connection structure 6 may be a touch fastener. One of the first connection structure 61 and the second connection structure 63 is a master patch, and the other one of the first connection structure 61 and the second connection structure 63 is an attached patch.

It is worth mentioning that in some embodiments, the bearing board assembly 3 is arranged with a lifting handle 39, such that when the bearing board assembly 3 and the middle board 16 are connected based on the connection structure 6, the user may easily separate the bearing board assembly 3 away from the middle board 16 through the lifting handle 39.

The board-carrying support device further includes at least one storage container 7 for providing a storage space 7A. The storage container 7 may be defined at one or more positions of the support frame 1. Specifically, the user may quickly place items, such as puzzle pieces, drawings, tools, and so on, in the storage container 7 of the board-carrying support device, such that the items may be stored. Further, the user may timely access the corresponding items. In particular when the user is playing the jigsaw puzzle games, the user may place and timely access the puzzle pieces, such that a neat and orderly playing environment may be provided.

It is worth mentioning that the storage container 7 may be a flip typed container, a drawer container, a removable container, and so on. In the present embodiment, in order to ensure compactness of the board-carrying support device, the storage container 7 is configured as a drawer and may be hidden in the support frame 1. In this way, configuration of the storage container 7 may not affect an appearance of the board-carrying support device. In particular, the configuration of the storage container 7 may not increase a space occupied by the board-carrying support device. Aesthetics of the board-carrying support device is ensured while the storage function of the board-carrying support device is improved.

Figure 14:
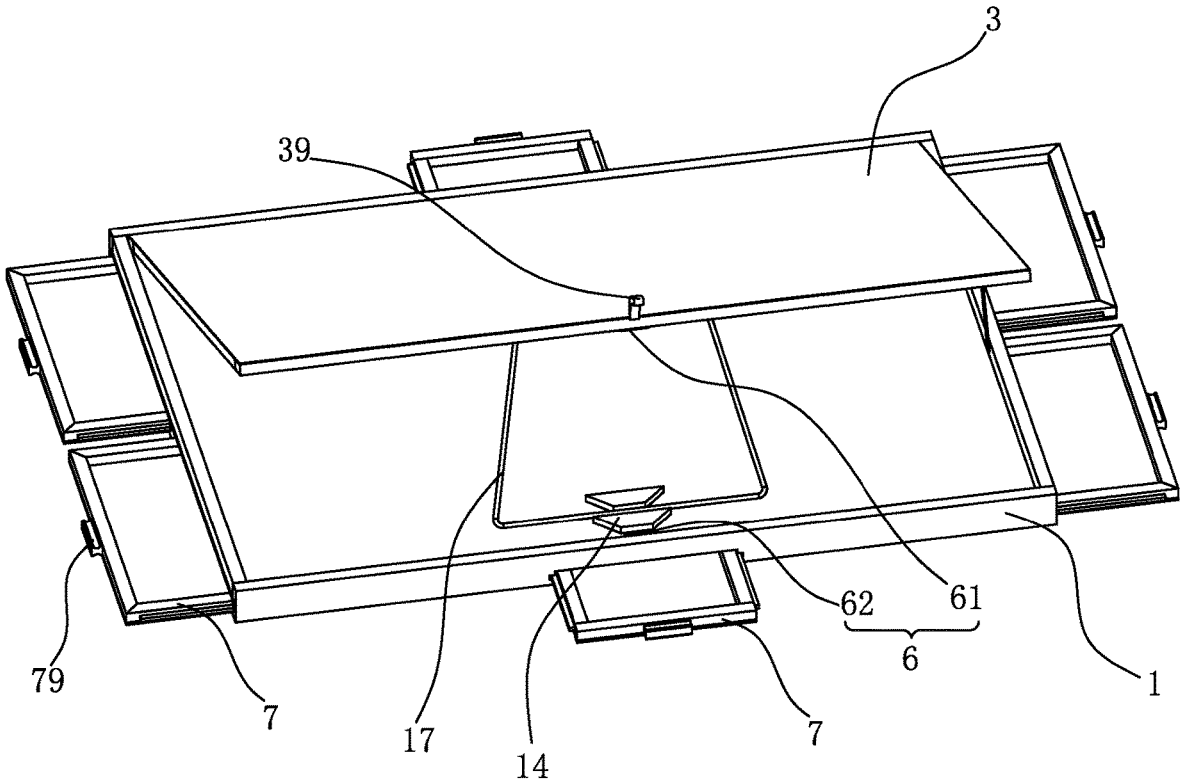
FIG. 14 is a perspective view of the board-carrying support device according to another embodiment of the present disclosure.

The support frame 1 is arranged with at least one storage container 7. In the present embodiment, four storage containers 7 are arranged. In other embodiments, as shown in FIG. 14, six storage containers 7 are arranged. Alternatively, more storage containers 7 may be arranged, the number of storage containers 7 may be determined based on demands.

Specifically, the storage container 7 includes a container bottom wall 71, a container front wall 73, a container back wall 75, and a pair of container side walls 77. The container front wall 73 and the container back wall 75 are opposite and spaced apart from each other. The pair of container side walls 77 are connected to the container front wall 73 and container back wall 75. Each of the container front wall 73, the container back wall 75, and the container side walls 77 is extending from the container bottom wall 71 in a direction away from the container bottom wall 71. The container bottom wall 71, the container front wall 73, the container back wall 75, and the container side walls 77 cooperatively define the storage space 7A. In this way, the storage space 7A may be arranged to store items. In a state that the storage container 7 is pushed to be received in the accommodation space of the support frame 1, the container front wall 73 of the storage container 7 may block the accommodation space, ensuring the aesthetics of the board-carrying support device.

Further, in the present embodiment, the support frame 1 further includes at least one second reinforcing member 15 connected to the support frame 1. The second reinforcing member 15 is disposed on a side of the middle board 16 away from the bearing board assembly 3 to support the middle board 16. The second reinforcing member 15 includes a first sub-reinforcing member 151, a second sub-reinforcing member 152, a third sub-reinforcing member 153, and a fourth sub-reinforcing member 154. The first sub-reinforcing member 151 is connected to the first side wall 11 and the second side wall 12 and is parallel to one of the pair of third side walls 13. The second sub-reinforcing member 152 is connected with the first sub-reinforcing member 151 and the third side wall 13. The third sub-reinforcing member 153 is parallel to and spaced apart from the first sub-reinforcing member 151. The fourth sub-reinforcing member 154 is connected to the third sub-reinforcing member 153 and the other one of the pair of third side walls 13. In the present embodiment, the second reinforcing member 15 further includes a fifth sub-reinforcing member 155 connected with the first sub-reinforcing member 151 and the third sub-reinforcing member 153. To be understood that, only two first sub-reinforcing members 151 may be arranged to form a cross.

The second reinforcing member 15 is arranged on a side of at least one container side wall 77. One of the container side wall 77 and the second reinforcing member 15 is arranged with a protrusion A, and the other one of the container side wall 77 and the second reinforcing member 15 defines a slide slot B for insertion of the protrusion A. The slide slot B extends in a direction of an extension of the side wall 77. In this way, the storage container 7 may be arranged in the support frame 1 in a push-pull manner.

Figure 4:
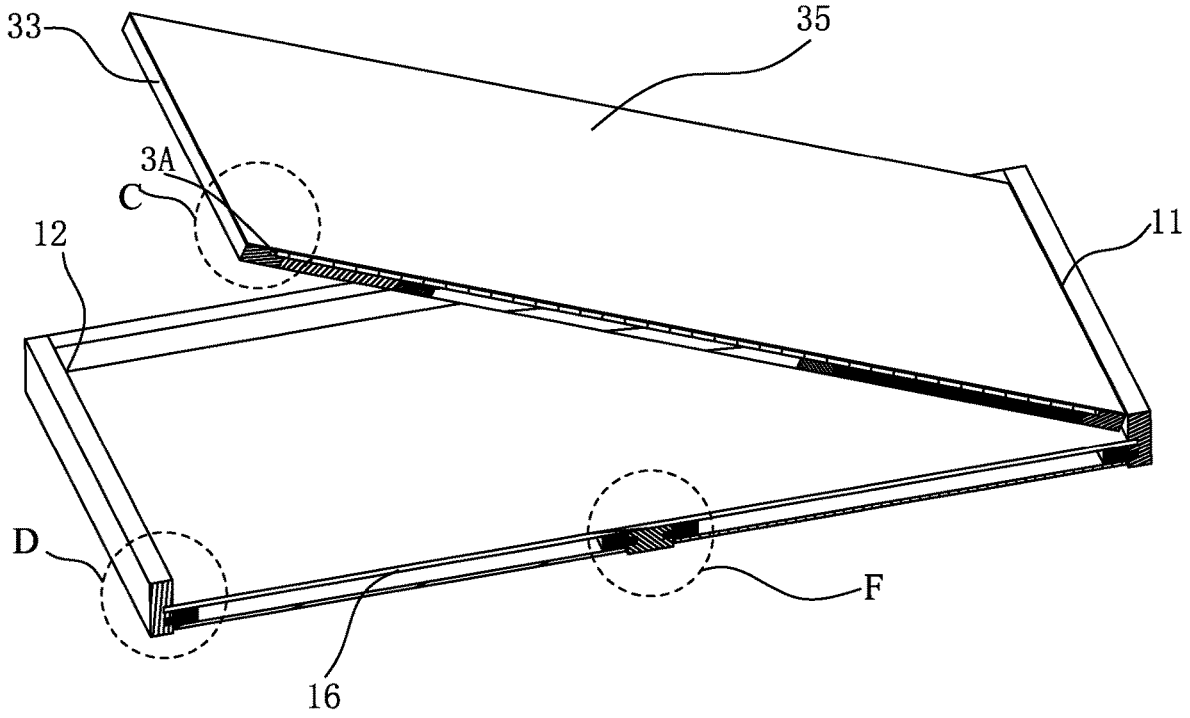
FIG. 4 is a cross-sectional view of the board-carrying support device shown in FIG. 2, taken along a line A-A.
Figure 5:
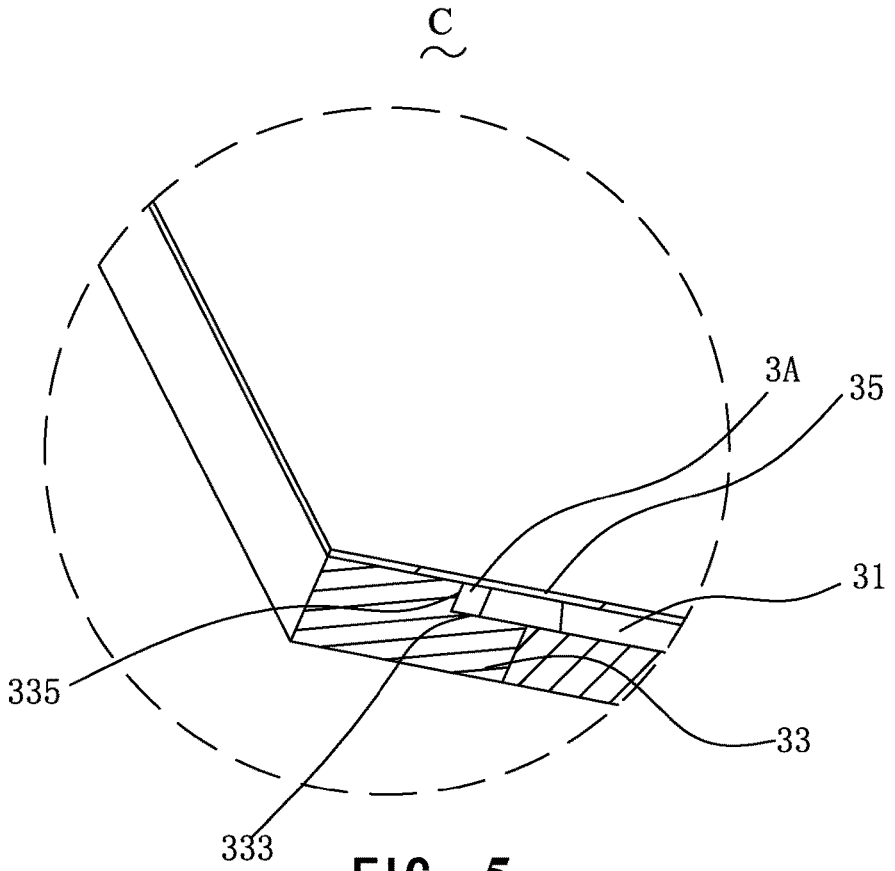
FIG. 5 is an enlarged view of a portion C shown in FIG. 4.
Figure 6:
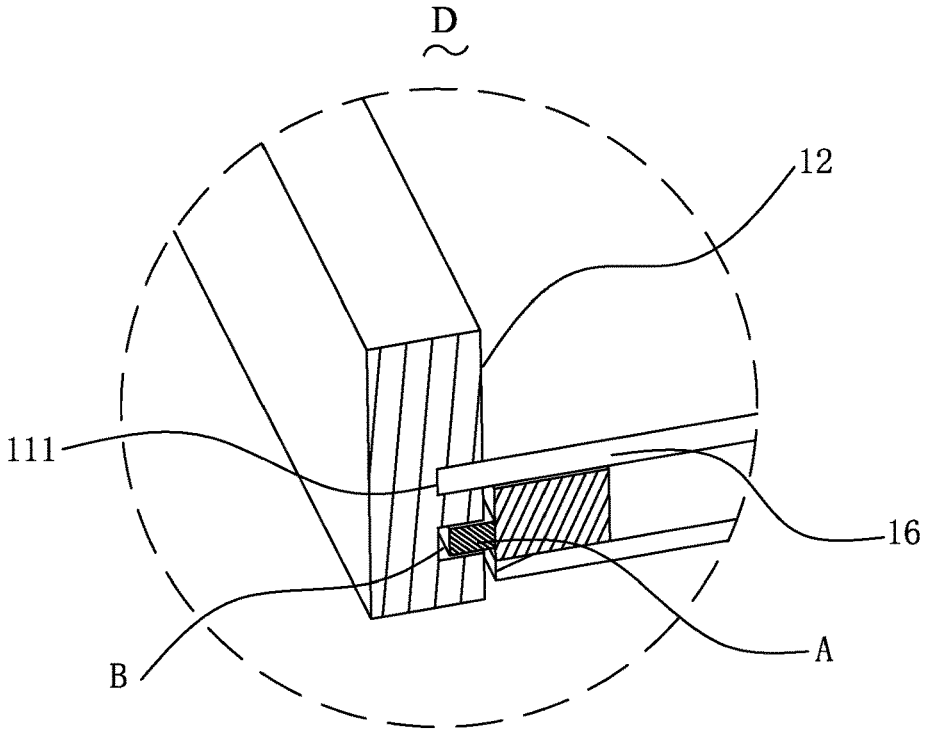
FIG. 6 is an enlarged view of a portion D shown in FIG. 4.
Figure 7:
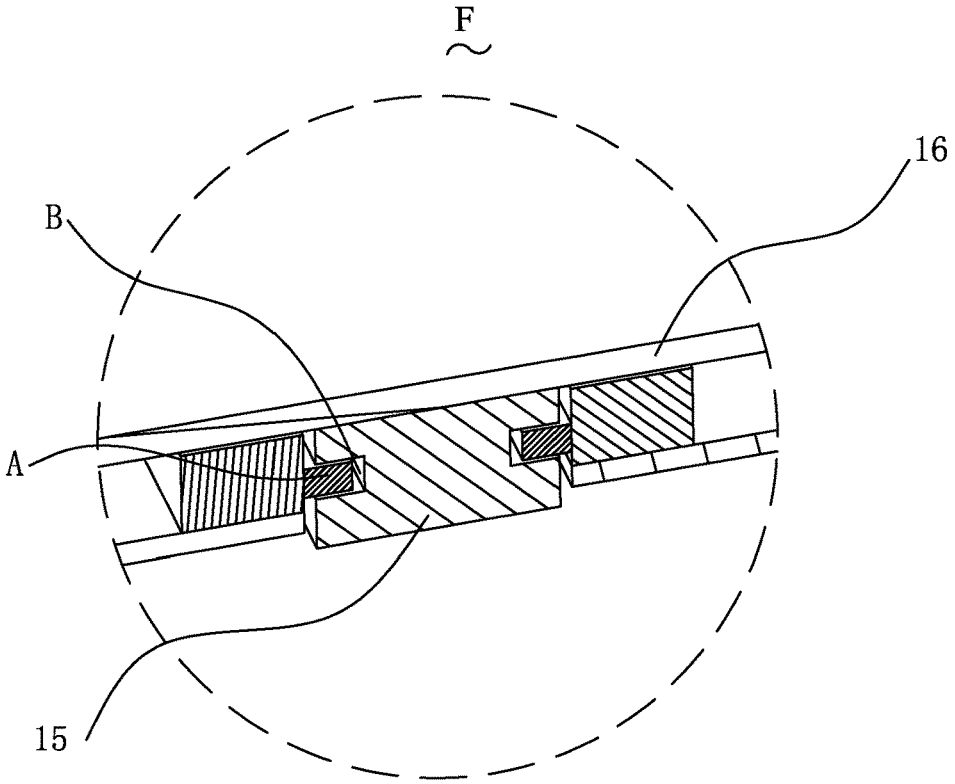
FIG. 7 is an enlarged view of a portion F shown in FIG. 4.
Figure 8:
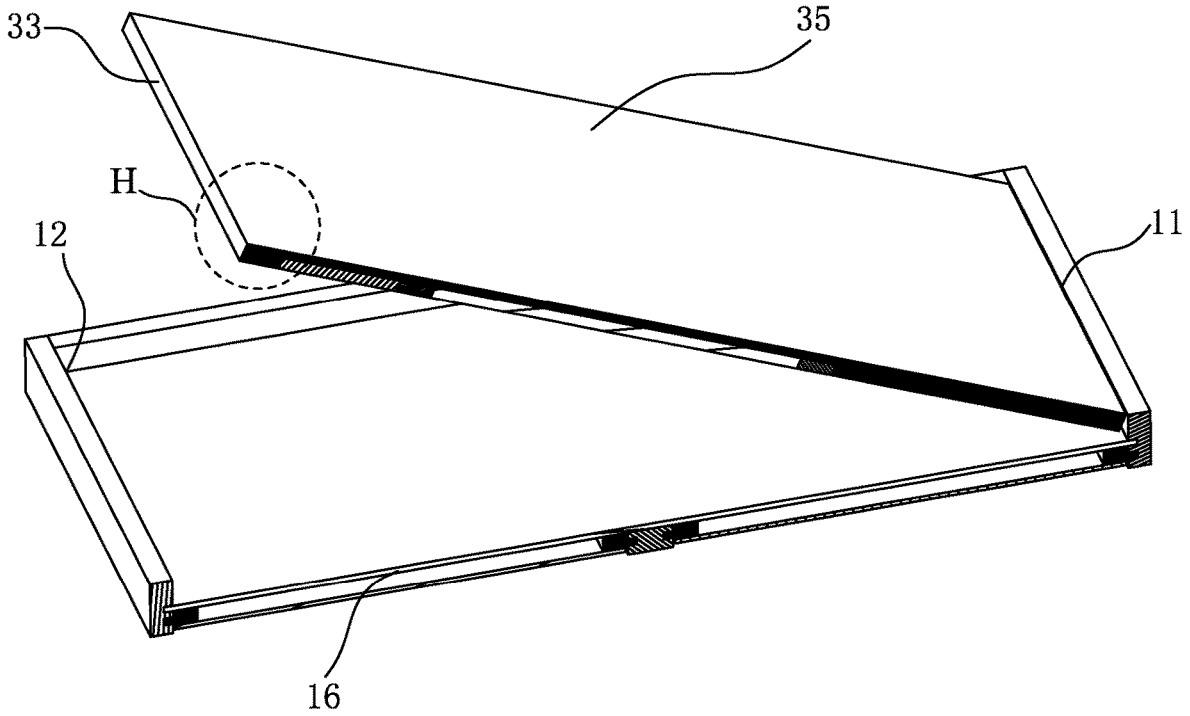
FIG. 8 is a cross-sectional view of the board-carrying support device shown in FIG. 2, taken along a line A-A, according to another embodiment of the present disclosure.
Figure 9:
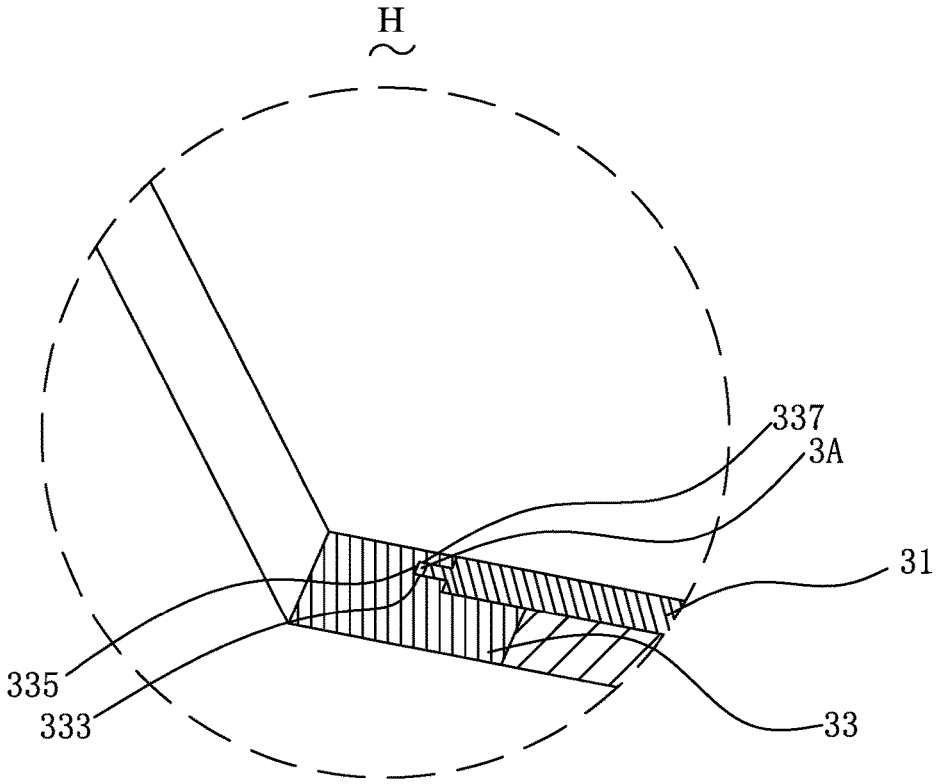
FIG. 9 is an enlarged view of a portion H shown in FIG. 8.
Figure 10:
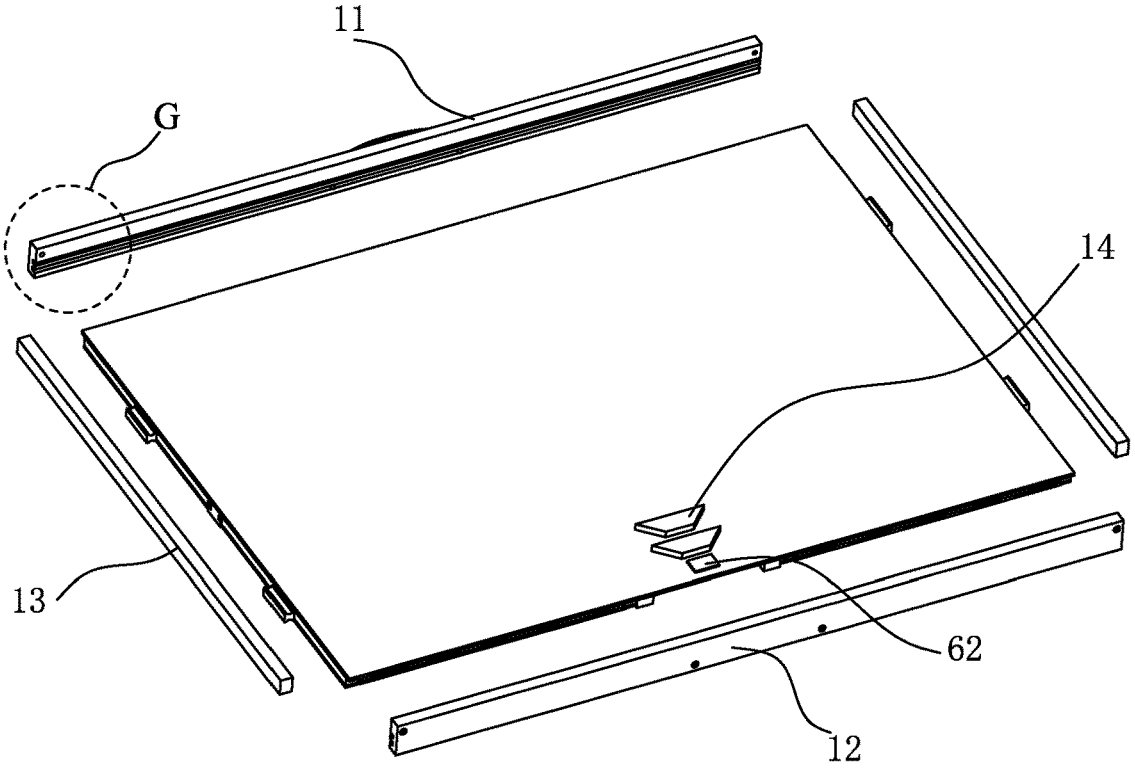
FIG. 10 an explosive view of the support frame with the middle frame and the storage container shown in FIG. 1.
Figure 11:
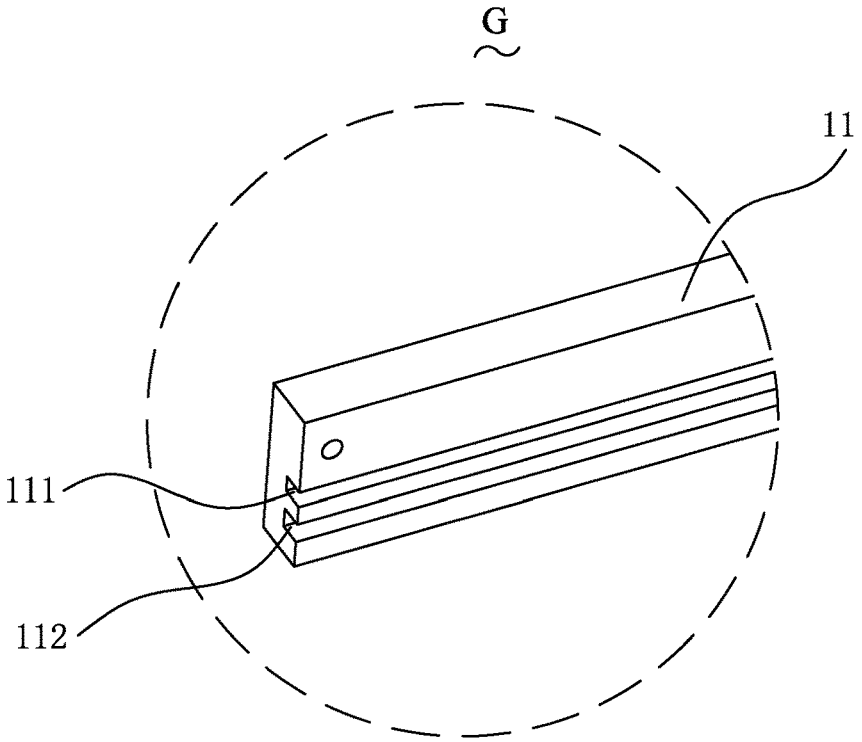
FIG. 11 is an enlarged view of a portion G shown in FIG. 10.
Figure 12:
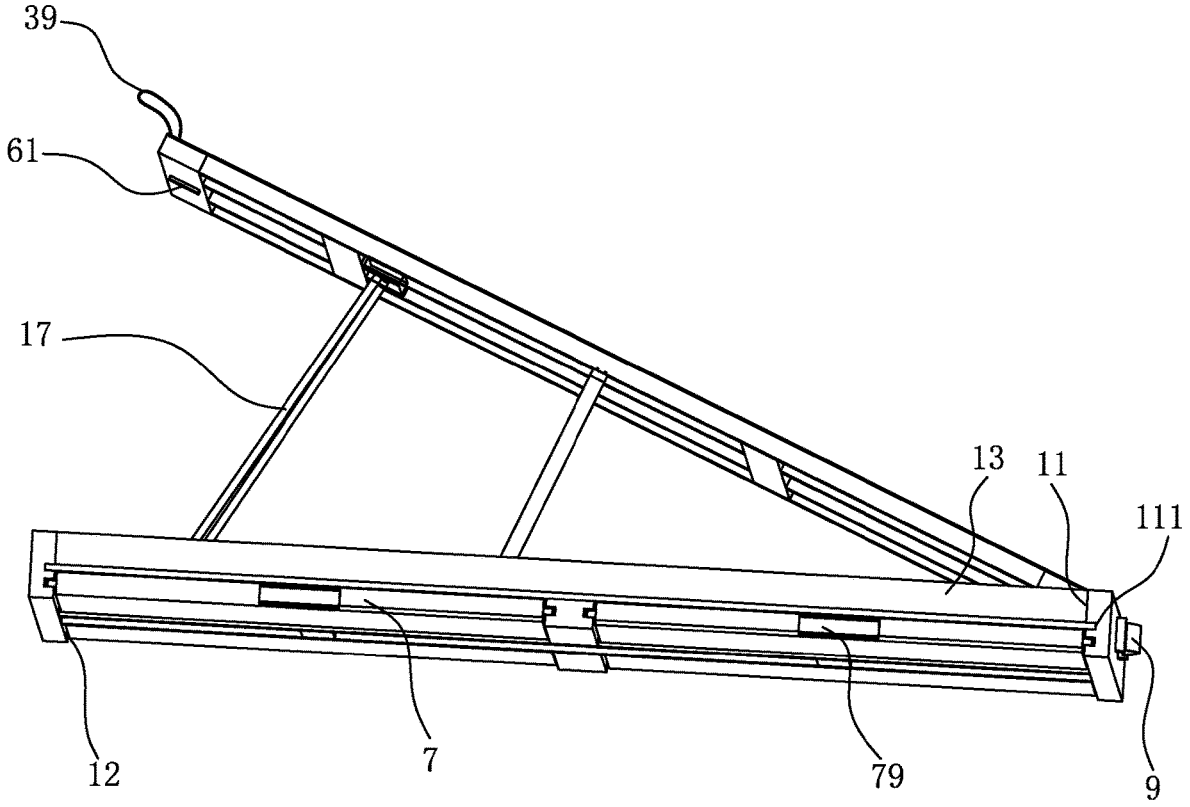
FIG. 12 is a perspective view of the board-carrying support device shown in FIG. 2, viewed from another viewing angle.
Figure 13:
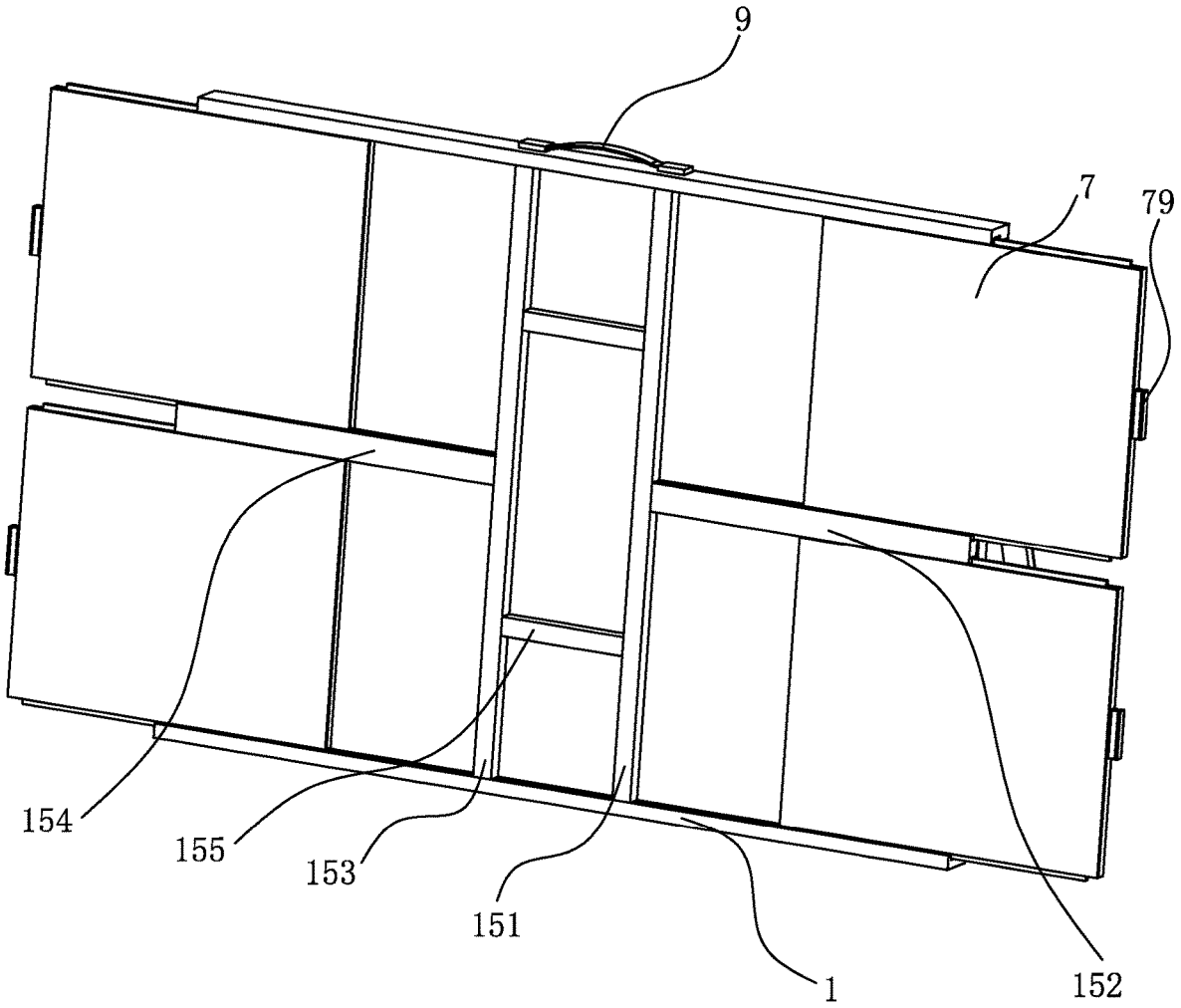
FIG. 13 is a perspective view of the board-carrying support device shown in FIG. 2, viewed from another viewing angle.

As shown in FIG. 4, the protrusion A is arranged on the container side wall 77, and the slide groove B is defined in the second reinforcing member 15. The protrusion A is an elongated protrusion. In the present embodiment, the first side wall 11 defines a second recess 112, and the corresponding second reinforcing member 152 defines a slide slot B. The container side wall 77 is arranged with the protrusion A. The protrusion A is accommodated in the second recess 112 and the slide slot B, allowing the storage container 7 to be supported.

It will be understood that in some embodiment, the protrusion A may be arranged on the second reinforcing member 15, and accordingly, the slide slot B is defined in the storage side wall 77. The protrusion A may be a single point protrusion.

The front wall 73 is arranged with a pulling handle 79 for pushing and pulling the storage container 7. The user may pull the storage container 7 by operating the pulling handle 79 to access to the storage space 7A.

The pulling handle 79 is a protrusion fixedly arranged on the container front wall 73. It will be understood that in some embodiments, the pulling handle 79 may be a puller slot, formed by the container front wall 73 being recessed.

Further, in order to facilitate carrying and transporting the board-carrying support device by the user, a handle 9 is fixedly arranged on an outside of the support frame 1 to facilitate the user to carry the board-carrying support device by the handle 9, increasing the ease of use of the board-carrying support device. The handle 9 may be implemented as a fixed handle, or a slot or a hole defined in the support frame 1 that can be easily held, or a movable handle, and so on.

Embodiment II

Figure 16:
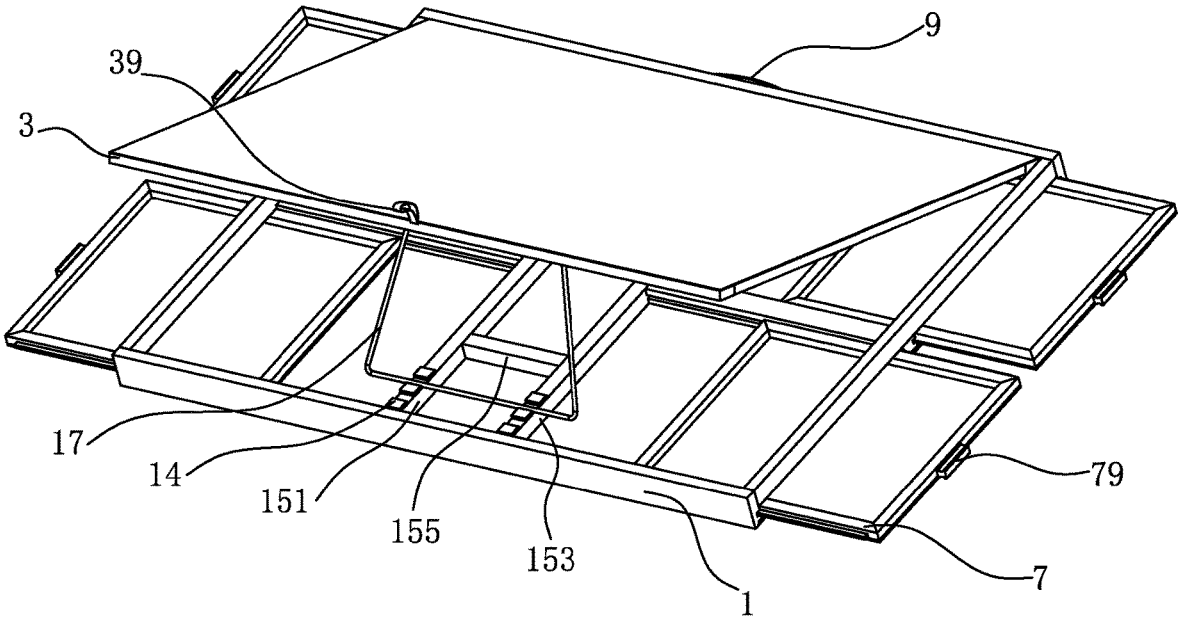
FIG. 16 is a perspective view of the board-carrying support device according to an Embodiment II of the present disclosure.
Figure 17:
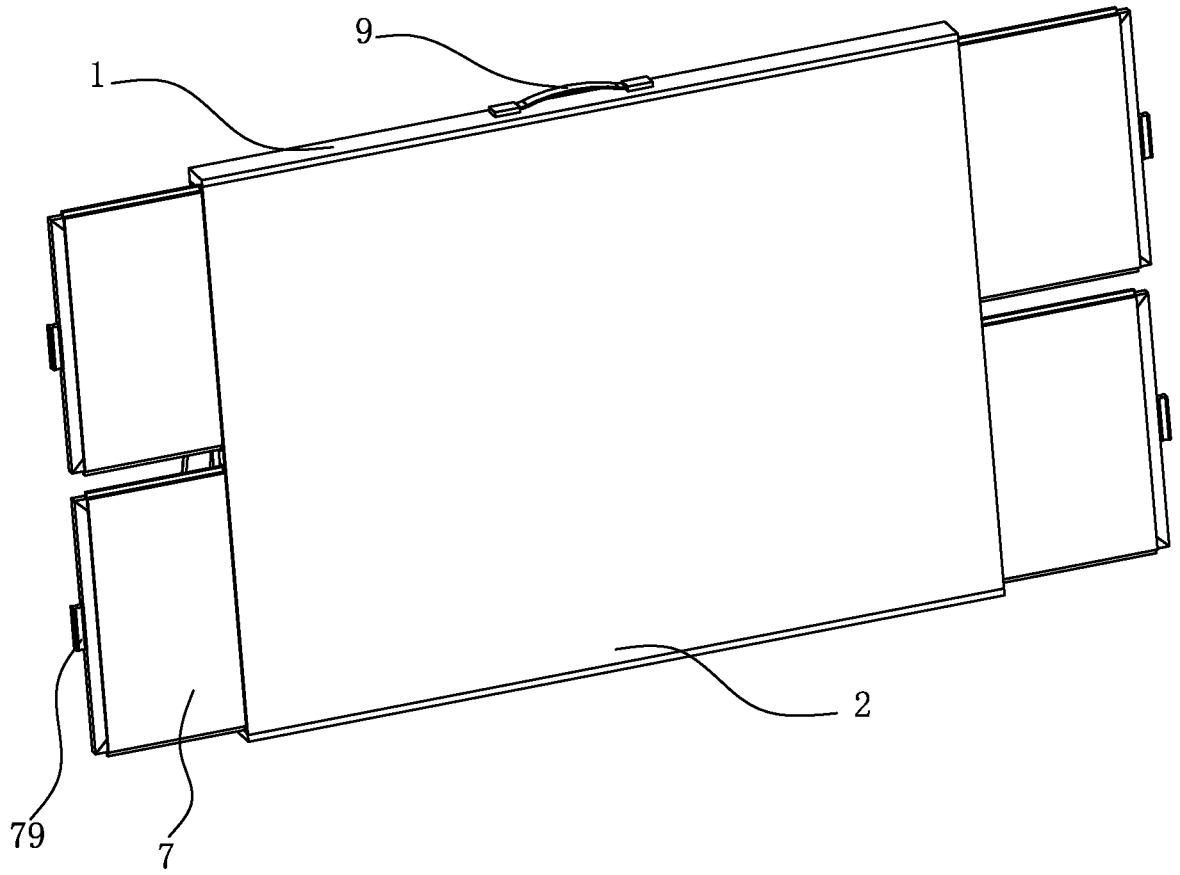
FIG. 17 is another perspective view of the board-carrying support device according to the Embodiment II of the present disclosure.

In the present embodiment, as shown in FIG. 16-17, the difference between the Embodiment II and the Embodiment I is that, for the board-carrying support device of Embodiment II, the middle board 16 is omitted from the support frame 1.

The support frame 1 includes the second reinforcing member 15, the storage container 7 arranged inside the support frame 1, and a bottom board 2 connected to a side of the support frame 1 away from the bearing board assembly 3. The bottom board 2 is configured to support the storage container 7.

Embodiment III

Figure 18:
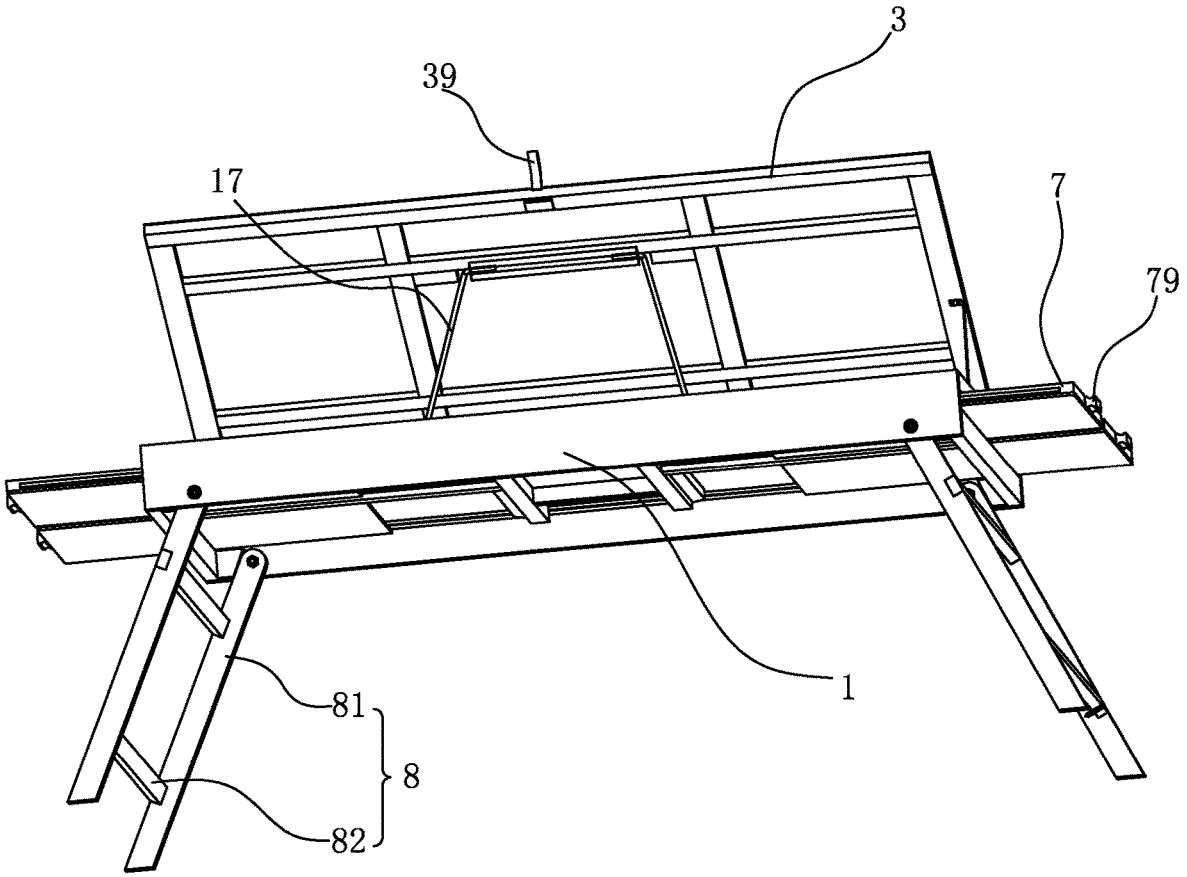
FIG. 18 is a perspective view of the board-carrying support device according to an Embodiment III of the present disclosure.
Figure 19:
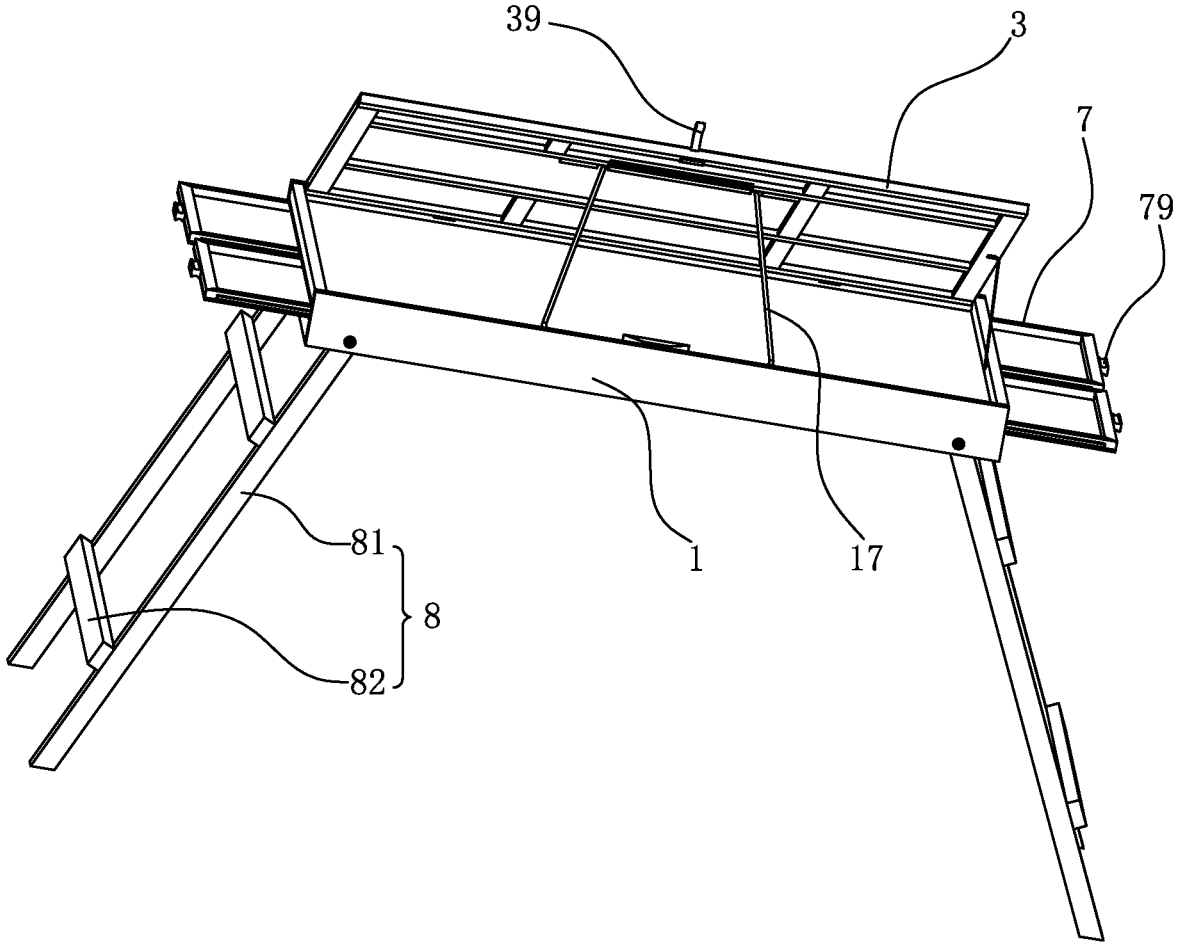
FIG. 19 is another perspective view of the board-carrying support device according to the Embodiment III of the present disclosure.

In the present embodiment, as shown in FIG. 18-19, the board-carrying support device is the same as that in the Embodiment I. The difference between the Embodiment III and the Embodiment I is that the board-carrying support device of the present embodiment further includes a support structure 8 connected to the support frame 1.

The support structure 8 is an upholding frame. The upholding frame is rotatably connected to the support frame 1. When the board-carrying support device is in use, the upholding frame 8 is rotated to an opening position. When the board-carrying support device is not in use, the upholding frame 8 is rotated to a collapse position. In this way, balance of the board-carrying support device is maintained. In particular, while the jigsaw puzzle game is being performed, since the upholding frame 8 is expanded, the board-carrying support device may be placed in a balanced position, providing stable support for the puzzle pieces. In addition, the upholding frame 8 may be folded, facilitating the board-carrying support device to be stored, and increasing practicality of the board-carrying support device.

The upholding frame 8 is arranged with two support legs 81 opposite to each other. Each support leg 81 includes two support legs 81 that are parallel to each other and a balance bar 82 connected between the two support legs 81. Preferably, two balance bars 82 are arranged and are parallel to each other.

Preferably, the upholding frame 8 is configured to have a maximum expanded angle. The maximum expanded angle is a maximum angle between the upholding frame 8 and the reference plane. The maximum expanded angle is preferably greater than or equal to 90° and less than 180°. In this way, balance of the board-carrying support device can be optimally ensured, and that is, a support applied by the upholding frame 8 to the support frame 1 can be ensured. Therefore, the board-carrying support device can be placed in a balanced position, the puzzle pieces may be prevented from being scattered around due to instability of the board-carrying support device, such that the mood of the player of the jigsaw puzzles may not be affected, and a better puzzle playing experience can be provided.

It should be noted that the collapse position of the upholding frame 8 is a position, which is reached by the upholding frame 8 being rotated and is parallel or nearly parallel to the reference plane. It will be understood that the collapse position is not limited to the position, which is reached by the upholding frame 8 being rotated and is parallel or nearly parallel to the reference plane. The collapse position may be a position, which is reached by the upholding frame 8 being rotated and has an angle of, such as, 3°, 5°, 8°, and so on, with respect to the reference plane.

The opening position of the upholding frame 8 is a position, which is reached by the upholding frame 8 being rotated and has the maximum expanded angle with respect to the reference plane.

The upholding frame 8 is rotatably connected to the inner side of the support frame 1. When the upholding frame 8 is rotated to the collapse position, the upholding frame 8 is received inside the support frame 1, further facilitating the storage of the board-carrying support device and increasing the practicality of the board-carrying support device.

Figure 2:
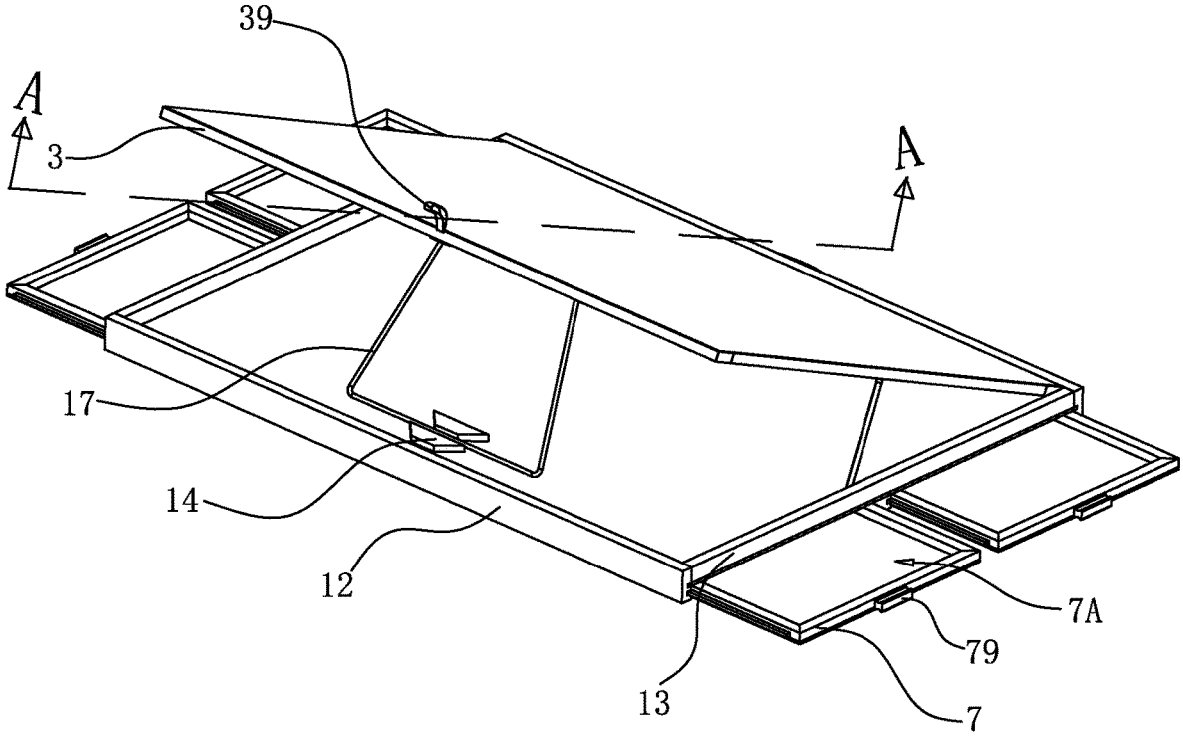
FIG. 2 is a perspective view of the bearing board assembly of the board-carrying support device shown in FIG. 1 being in the second position.
Figure 3:
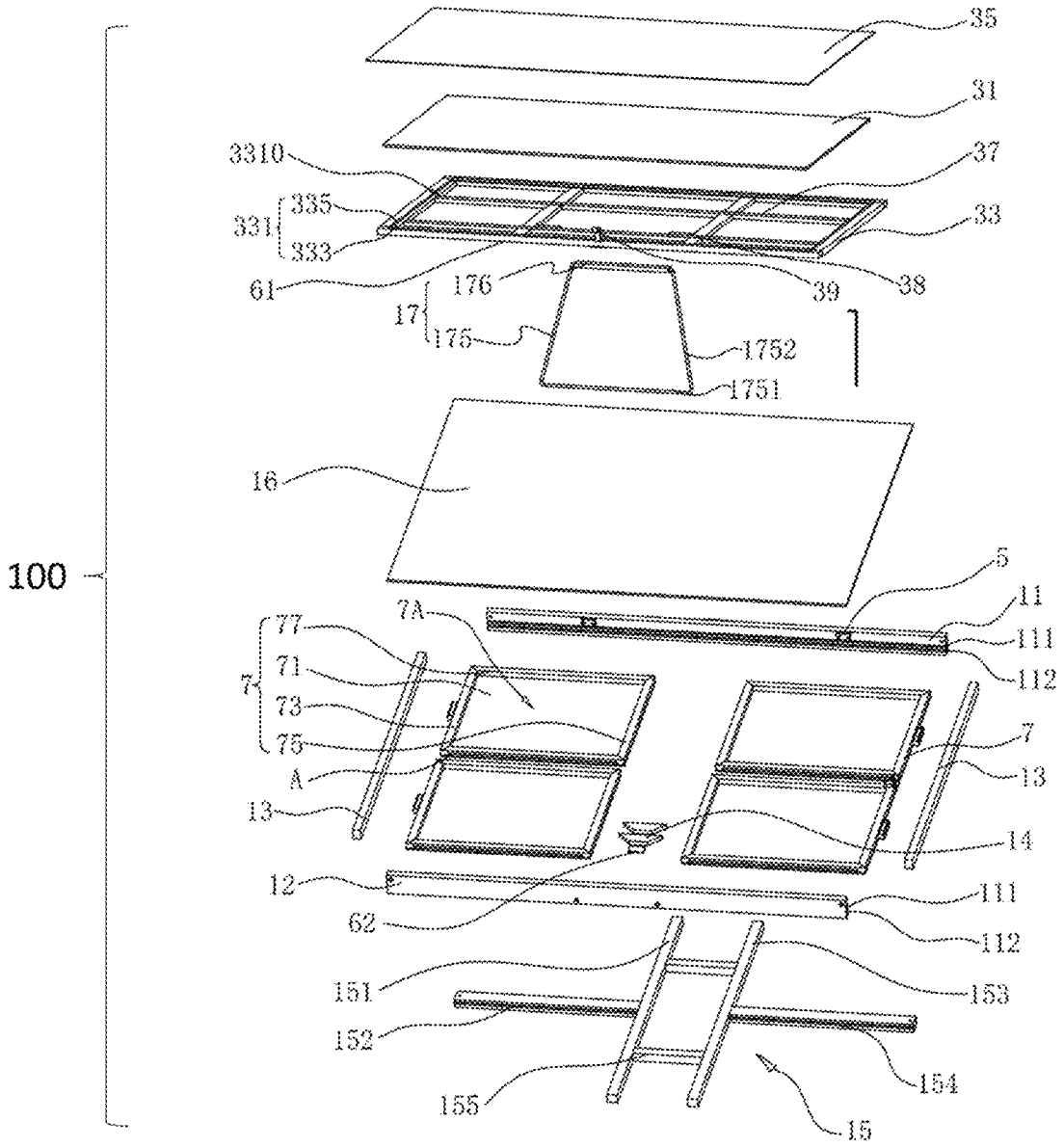
FIG. 3 is an explosive view of the board-carrying support device shown in FIG. 1.

It is worth mentioning that, since both the bearing board assembly 3 and the upholding frame 8 can be rotated to the respective collapse positions and stored in the support frame 1, and since the storage container 7 is allowed to be pushed into the accommodation opening 1B and is hiddenly received in the support frame 1, the board-carrying support device is allows to be folded into a form having a size of only one panel, such as the board-carrying support device in the folded position as shown in FIG. 1 and FIG. 2. The board-carrying support device is folded to a size of a frame surface of the support frame 1. In this way, a minimal area is occupied to store the board-carrying support device. Therefore, the board-carrying support device may be stored flexibly, and the user may carry and transport the board-carrying support device easily.

Embodiment IV

Figure 20:
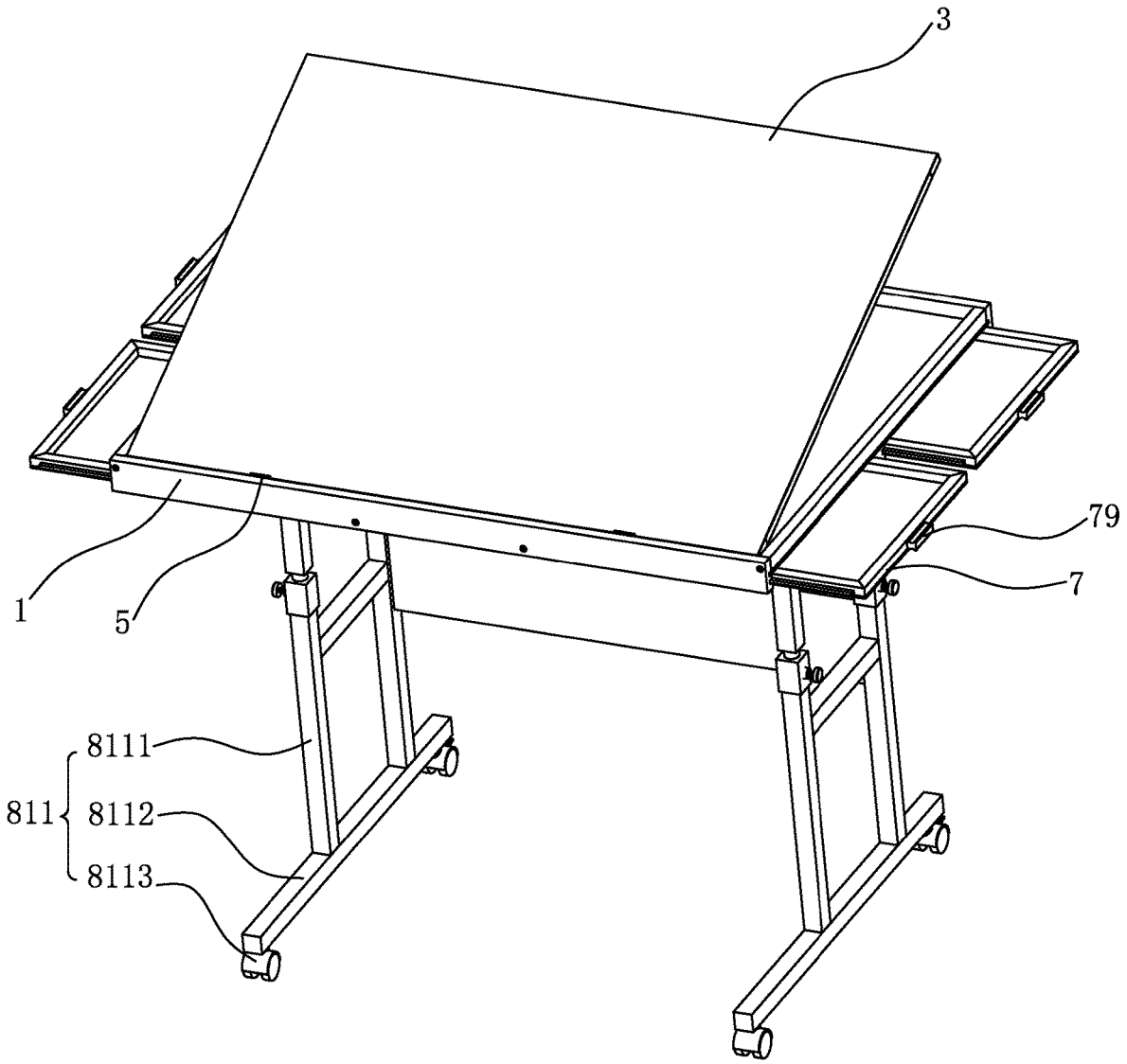
FIG. 20 is a perspective view of the board-carrying support device according to an Embodiment IV of the present disclosure.
Figure 21:
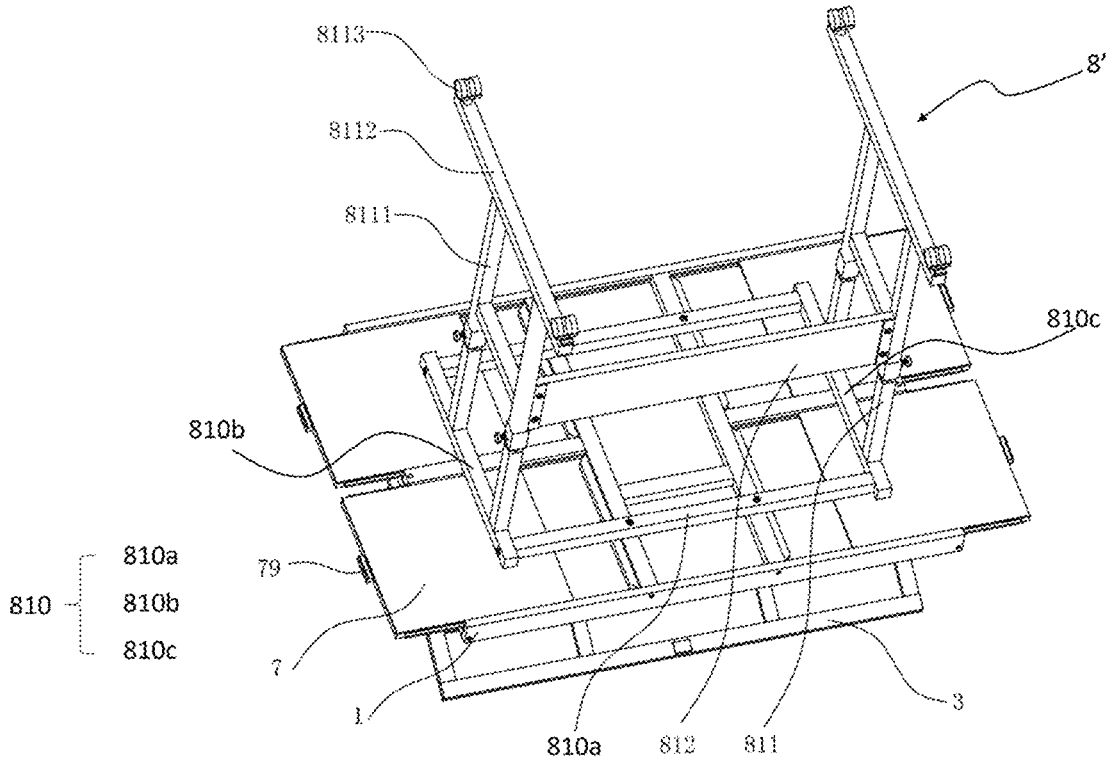
FIG. 21 is another perspective view of the board-carrying support device according to the Embodiment IV of the present disclosure.

The Embodiment IV differs from the embodiment III only in that, as shown in FIGS. 20-21, the support structure 8' is different.

In the present embodiment, the support structure 8' includes a connection frame 810, a pair of support legs 811, and a support beam 812. The connection frame 810 is connected to the support frame 1. The pair of support legs 811 extend from opposite sides of the connection frame 810 in a direction away from the reinforcing member. The support beam 812 is connected with the pair of support legs 811. Each support leg 811 includes two support feet 8111 parallel with each other and a connection beam 8112 connected with the two support feet 8111. A universal wheel 8113 is arranged at a bottom of the connection beam 8112. In the present embodiment, a height of the support feet 8111 is adjustable.

The board-carrying support device includes: a support frame 1; a puzzle carrying board assembly 100, connected to the support frame 1 and having a surface configured to support puzzle pieces; and a reinforcing assembly. The reinforcing assembly includes the plurality of reinforcing members 151 to 155 as described in the above embodiments and are arranged on the other surface of the puzzle carrying board assembly 100 away from the surface configured to support puzzle pieces. The support frame 1 includes a first side edge 110, a second side edge 120, a third edge 130 opposite to and spaced apart from the first side edge 110, and a fourth edge 140 opposite to and spaced apart from the second side edge 120. The second side edge 120 is connected between an end of the first side edge 110 and an end of the third side edge 130, the fourth side edge 140 is connected between the other end of the first side edge 110 and the other end of the third side edge 130. The plurality of reinforcing members 151 to 155 include a first reinforcing member, a second reinforcing member 152, and a third reinforcing member 154. The first reinforcing member is extending to substantially reach the first side edge 110 and the third side edge 130; the second reinforcing member 152 is connected between the first reinforcing member and the second side edge 120. The third reinforcing member 154 is connected between the first reinforcing member and the fourth side edge 140.

In detail, the upholding frame 8' supports the reinforcing assembly 15. The upholding frame 8' is extendable and retractable to change a support height; the upholding frame 8' includes a plurality of connection rods supporting the reinforcing assembly 15. An orthographic projection of at least one reinforcing member of the plurality of reinforcing members 151 to 155 onto the other surface of the puzzle carrying board intersects with an orthographic projection of at least one connection rod of the plurality of connection rods onto the other surface of the puzzle carrying board.

More than one of the plurality of connection rods are connected to each other to form the connection frame 810, and the connection frame 810 is connected to at least the reinforcing members 151 and 153. An orthographic projection of the connection frame 810 onto the other surface of the puzzle carrying board assembly intersects with an orthographic projection of any one reinforcing member of the plurality of reinforcing members 151 to 155 onto the other surface of the puzzle carrying board. An orthographic projection of a first connection rod 810*a* and a second connection rod 810*b* of the connection frame onto the other surface of the puzzle carrying board assembly intersects with both an orthographic projection of the reinforcing member 153 onto the other surface of the puzzle carrying board and an orthographic projection of the reinforcing member 154 onto the other surface of the puzzle carrying board assembly. An orthographic projection of the first connection rod 810*a* and a third connection rod 810*c* of the connection frame 810 onto the other surface of the puzzle carrying board assembly intersects with both an orthographic projection of the reinforcing member 151 onto the other surface of the puzzle carrying board and an orthographic projection of the reinforcing member 152 onto the other surface of the puzzle carrying board.

An orthographic projection of any one of the plurality of connection beams 8112 onto the other surface of the puzzle carrying board assembly intersects with an orthographic projection of at least one reinforcing member of the plurality of reinforcing members 151 to 155 onto the other surface of the puzzle carrying board assembly.

When the puzzle carrying board assembly is horizontally placed to support the puzzle pieces, an extension direction of the support beam 812 is substantially parallel to at least one reinforcing member of the plurality of reinforcing members 151 to 155.

Two storage containers 7 are pullable from the second side edge 120 of the support frame 1; another two storage containers 7 are pullable from the fourth side edge 140 of the support frame 1. The reinforcing member 152 is located between the two storage containers 7; and the reinforcing member 154 is located between the another two storage containers 7.

An orthographic projection of one of the plurality of connection beams 8112 onto the other surface of the puzzle carrying board assembly 100 intersects with an orthographic projection of the reinforcing member 152 onto the other surface of the puzzle carrying board assembly 100. The orthographic projection of one of the plurality of connection beams 8112 onto the other surface of the puzzle carrying board intersects with an orthographic projection of the reinforcing member 154 onto the other surface of the puzzle carrying board assembly 100.

Any ordinary skilled person in the art shall understand that the above embodiments are specific implementation of the present disclosure. In practice, forms and details of the embodiments may be changed without departing from the spirit and scope of the present disclosure.

What is claimed is:

1. A board-carrying support device, comprising:

a support frame;

a puzzle carrying board assembly, connected to the support frame and having a surface configured to support puzzle pieces;

a plurality of storage containers, arranged with the support frame and slidably connected to the puzzle carrying board assembly;

a reinforcing assembly, wherein the reinforcing assembly comprises a plurality of reinforcing members and are arranged on the other surface of the puzzle carrying board assembly away from the surface configured to support puzzle pieces;

an upholding frame, supporting the reinforcing assembly;

wherein, the upholding frame comprises: a plurality of connection rods, a plurality of support legs, a support beam, and a plurality of connection beams; the plurality of support legs are extendable and retractable to change a support height;

an orthographic projection of at least one reinforcing member of the plurality of reinforcing members onto the other surface of the puzzle carrying board assembly intersects with an orthographic projection of at least one connection rod of the plurality of connection rods onto the other surface of the puzzle carrying board assembly;

the support beam is connected between two of the plurality of support legs, each of the plurality of connection beams is arranged at an end of a respective one of the plurality of support legs away from the plurality of connection rods; an extending direction of the support beam is non-parallel to an extending direction of each of the plurality of connection beams;

an orthographic projection of the support beam onto the other surface of the puzzle carrying board assembly intersects with an orthographic projection of at least one of the plurality of reinforcing members onto the other surface of the puzzle carrying board assembly; and an orthographic projection of each of the plurality of connection beams onto the other surface of the puzzle carrying board assembly intersects with an orthographic projection of at least another one of the plurality of reinforcing members onto the other surface of the puzzle carrying board assembly;

wherein the support frame comprises a first side edge, a second side edge, a third side edge opposite to and spaced apart from the first side edge, and a fourth side edge opposite to and spaced apart from the second side edge; the second side edge is connected between an end of the first side edge and an end of the third side edge, the fourth side edge is connected between the other end of the first side edge and the other end of the third side edge;

the plurality of reinforcing members comprise a first reinforcing member, a second reinforcing member, and a third reinforcing member;

the first reinforcing member is extending to substantially reach the first side edge and the third side edge; the second reinforcing member is connected between the first reinforcing member and the second side edge; and the third reinforcing member is connected between the first reinforcing member and the fourth side edge.

2. The board-carrying support device according to claim 1, wherein the support frame comprises a side wall located at and extending along one of the first side edge, the second side edge, the third edge, and the fourth edge; and the side wall is extending from an uppermost surface of the puzzle carrying board assembly to a bottommost surface of the puzzle carrying board assembly and is an integral and one-piece structure.

3. The board-carrying support device according to claim 1, wherein, each of the plurality of connection rods is spaced apart from any edge of the support frame.

4. The board-carrying support device according to claim 1, wherein the first reinforcing member comprises a first sub-reinforcing member and a second sub-reinforcing member, the first sub-reinforcing member and the second sub-reinforcing member are substantially parallel to and spaced apart from each other;

the second reinforcing member is connected between the first sub-reinforcing member and the second side edge; the third reinforcing member is connected between the second sub-reinforcing member and the fourth side edge.

5. The board-carrying support device according to claim 4, wherein, the plurality of reinforcing members further comprise at least one fourth reinforcing member connected between the first sub-reinforcing member and the second sub-reinforcing member.

6. The board-carrying support device according to claim 5, wherein the at least one fourth reinforcing member comprise a plurality of fourth sub-reinforcing members, and the plurality of fourth sub-reinforcing members are substantially parallel to each other and are spaced apart from each other;

an extension direction of the at least one fourth reinforcing member does not coincide with an extension direction of the second reinforcing member and does not coincide with an extension direction of the third reinforcing member.

7. The board-carrying support device according to claim 1, wherein at least one of the plurality of connection rods supports the first reinforcing member.

8. The board-carrying support device according to claim 4, wherein at least one of the plurality of connection rods supports both the first sub-reinforcing member and the second sub-reinforcing member.

9. The board-carrying support device according to claim 1, wherein more than one of the plurality of connection rods are connected to each other form a connection form; an orthographic projection of the connection frame onto the other surface of the puzzle carrying board assembly intersects with an orthographic projection of any one reinforcing member of the plurality of reinforcing members onto the other surface of the puzzle carrying board assembly.

10. The board-carrying support device according to claim 1, wherein more than one of the plurality of connection rods are connected to each other form a connection form; an orthographic projection of a first connection rod and a second connection rod of the connection frame onto the other surface of the puzzle carrying board assembly intersects with both an orthographic projection of the first reinforcing member onto the other surface of the puzzle carrying board assembly and an orthographic projection of the second reinforcing member onto the other surface of the puzzle carrying board assembly; and/or wherein more than one of the plurality of connection rods are connected to each other form a connection form; an orthographic projection of a first connection rod and a third connection rod of the connection frame onto the other surface of the puzzle carrying board assembly intersects with both an orthographic projection of the first reinforcing member onto the other surface of the puzzle carrying board assembly and an orthographic projection of the third reinforcing member onto the other surface of the puzzle carrying board assembly.

11. The board-carrying support device according to claim 1, wherein, when the puzzle carrying board assembly is horizontally placed to support the puzzle pieces, an extension direction of the support beam is substantially parallel to at least one reinforcing member of the plurality of reinforcing members.

12. A board-carrying support device, comprising:

a support frame;

a puzzle carrying board assembly, connected to the support frame and having a surface configured to support puzzle pieces;

a plurality of storage containers, arranged with the support frame and slidably connected to the puzzle carrying board assembly;

a reinforcing assembly, wherein the reinforcing assembly comprises a plurality of reinforcing members and are arranged on the other surface of the puzzle carrying board assembly away from the surface configured to support puzzle pieces;

an upholding frame, supporting the reinforcing assembly:

wherein, the upholding frame comprises: a plurality of connection rods, a plurality of support legs, a support beam, and a plurality of connection beams: the plurality of support legs are extendable and retractable to change a support height:

an orthographic projection of at least one reinforcing member of the plurality of reinforcing members onto the other surface of the puzzle carrying board assembly intersects with an orthographic projection of at least one connection rod of the plurality of connection rods onto the other surface of the puzzle carrying board assembly;

the support beam is connected between two of the plurality of support legs, each of the plurality of connection beams is arranged at an end of a respective one of the plurality of support legs away from the plurality of connection rods; an extending direction of the support beam is non-parallel to an extending direction of each of the plurality of connection beams;

an orthographic projection of the support beam onto the other surface of the puzzle carrying board assembly intersects with an orthographic projection of at least one of the plurality of reinforcing members onto the other surface of the puzzle carrying board assembly; and an orthographic projection of each of the plurality of connection beams onto the other surface of the puzzle carrying board assembly intersects with an orthographic projection of at least another one of the plurality of reinforcing members onto the other surface of the puzzle carrying board assembly:

wherein the support frame comprises a first side edge, a second side edge, a third side edge opposite to and spaced apart from the first side edge, and a fourth side edge opposite to and spaced apart from the second side edge: the second side edge is connected between an end of the first side edge and an end of the third side edge, the fourth side edge is connected between the other end of the first side edge and the other end of the third side edge;

the plurality of reinforcing members comprise a first reinforcing member, a second reinforcing member, and a third reinforcing member; the first reinforcing member is extending to substantially reach the first side edge and the third side edge; the second reinforcing member is connected between the first reinforcing member and the second side edge; and the third reinforcing member is connected between the first reinforcing member and the fourth side edge;

wherein two storage containers of the plurality of storage containers are pullable from the second side edge of the support frame; another two storage containers of the plurality of storage containers are pullable from the fourth side edge of the support frame;

the second reinforcing member is located between the two storage containers; and the third reinforcing member is located between the another two storage containers.

13. The board-carrying support device according to claim 12, wherein an orthographic projection of one of the plurality of connection beams onto the other surface of the puzzle carrying board assembly intersects with an orthographic projection of the second reinforcing member onto the other surface of the puzzle carrying board assembly; and/or wherein an orthographic projection of one of the plurality of connection beams onto the other surface of the puzzle carrying board assembly intersects with an orthographic projection of the third reinforcing member onto the other surface of the puzzle carrying board assembly.

14. The board-carrying support device according to claim 12, wherein the first reinforcing member is disposed at a side of the two storage containers away from the second side edge; a width of the first reinforcing member is less than a width of the second reinforcing member.

* * * * *